United States Patent [19]

Johnson

[11] Patent Number: 5,067,645

[45] Date of Patent: Nov. 26, 1991

[54] APPARATUS FOR SIZING ELONGATED FOOD PIECES

[75] Inventor: Roger D. Johnson, Canyon Country, Calif.

[73] Assignee: Nestec S.A., Vevey, Switzerland

[21] Appl. No.: 550,263

[22] Filed: Jul. 9, 1990

Related U.S. Application Data

[63] Continuation-in-part of Ser. No. 226,903, Aug. 1, 1988.

[51] Int. Cl.[5] ..... B26F 3/02; B26D 1/62

[52] U.S. Cl. ..... 225/93; 83/343; 83/733; 83/410.8; 241/236

[58] Field of Search ..... 83/343, 345, 331, 659, 83/346, 410, 410.7, 410.8, 411.3, 733; 198/631, 446; 225/93, 97, 103; 241/227, 236

[56] References Cited

U.S. PATENT DOCUMENTS

| | | | |
|---|---|---|---|
| 35,120 | 4/1862 | Whittemore | 83/343 |
| 2,829,695 | 4/1958 | Jarris | 241/227 |
| 3,339,703 | 9/1967 | Pinkham et al. | 198/446 X |
| 3,757,620 | 9/1973 | Cloud | 83/345 X |
| 4,060,166 | 11/1977 | Hartness et al. | 198/446 |

*Primary Examiner*—Douglas D. Watts
*Assistant Examiner*—Kenneth E. Peterson

[57] ABSTRACT

Apparatus for sizing a mix of randomly sized food pieces into chunks of a predetermined maximum length. The apparatus includes a carrier drum and a cutting drum mounted on parallel shafts which are interconnected for rotation in opposing directions. The carrier drum has a plurality of parallel longitudinal bars mounted equidistant around the periphery of the drum, spaced apart a distance equal to the desired maximum length of the food chunks. The cutting drum carries a plurality of elongated cutting blades mounted parallel to the longitudinal bars on the carrier drum and spaced apart the same distance as the longitudinal bars. The drums are aligned so that upon rotation of the drums the blades cooperate with the longitudinal bars to cut elongated food pieces carried on the surface of the bars into the nip between the drums, without striking against the bars. A conveyor mounted adjacent the carrier drum delivers a mix of randomly sized food pieces onto the carrier drum, with the longitudinal axes of the elongated pieces in the mix being aligned so that the elongated pieces are deposited on the longitudinal bars of the rotating carrier drum perpendicular to the axes of the bars and are carried into the nip between the counter rotating drum where they are cut to a desired length.

9 Claims, 3 Drawing Sheets

APPARATUS FOR SIZING ELONGATED FOOD PIECES

BACKGROUND OF THE INVENTION

This is a continuation-in-part of application Ser. No. 07,226,903 filed Aug. 1, 1988.

This invention relates to apparatus for sizing a mix of randomly sized food pieces into pieces of a predetermined maximum length. More particularly, the invention relates to apparatus for separating elongated pieces of a food product from a mix of randomly sized pieces and cutting the elongated pieces to a desired maximum length.

In recent years procedures have been developed for producing food products which resemble chunks of natural meat in appearance and texture. Such simulated meat chunks, which typically are formed of meat material and/or vegetable protein are desirable in both human and animal foods from the standpoint of aesthetic quality and consumer appeal as replacement for more costly natural meat chunks. Such simulated meat chunks may be produced by procedures, such as extrusion through a die orifice, which result in the formation of pieces having a relatively uniform size. Recently procedures have been developed for producing simulated chunks of natural meat having a random size distribution, that is, the chunks may range in size from about ½ inch (1.25 cm) or less to about 4 inches (10 cm) or more in length. While such randomly sized chunks are advantageous in that they more nearly simulate chunks of natural meat, the production of elongated chunks, this is, chunks having a length of more than about 2 inches (5 cm) makes it difficult to accurately fill the chunks into conventional packaging, such as cans, in a high speed commercial packaging operation. Thus, the elongated chunks are difficult to process in conventional filling equipment, and the presence of such elongated chunks makes accurate weight control of filled cans very difficult.

SUMMARY OF THE INVENTION

The present invention is directed to apparatus for separating elongated simulated meat chunks from a mixture of smaller randomly sized chunks and cutting the elongated chunks into pieces of a predetermined maximum length, in a high speed commercial production operation. The apparatus includes a pair of cylindrical members, that is, a carrier drum and a cutting drum, mounted for rotation on parallel shafts which are interconnected for rotation in opposite directions. The carrier drum has a plurality of longitudinal bars mounted equidistant around its periphery, with the bars being spaced apart a distance equal to the desired maximum length of the meat chunks to be processed. The cutting drum, which is mounted above the carrier drum, has a plurality of cutting blades secured around its periphery, with the blades being spaced apart the same distance as the spacing between the longitudinal bars of the carrier drum. Rotation of the drums brings each cutting blade into close proximity to, but not in contact with, a longitudinal bar of the carrier drum.

A mix of randomly sized meat chunks is deposited onto the surface of the carrier drum from a feed conveyor mounted above the carrier drum, with the conveyor having a number of longitudinal partitions at its discharge end so that the longitudinal axes of elongated meat chunks are aligned substantially parallel to their direction of travel. Meat chunks having a length smaller than the spacing between adjacent longitudinal bars of the carrier drum fall between the bars onto a take-away conveyor mounted below the carrier drum. Elongated meat chunks that is, pieces which have a length greater than the spacing between adjacent bars, are retained on the outer surface of the longitudinal bars of the carrier drum, with the chunks extending across two or more adjacent bars. The elongated chunks are carried into the nip between the drums where they are cut to a desired maximum length by a cutting blade in cooperation with longitudinal bar. When cut to the desired length, the pieces fall through the bars onto the take-away conveyor.

DETAILED DESCRIPTION

Figure 1:
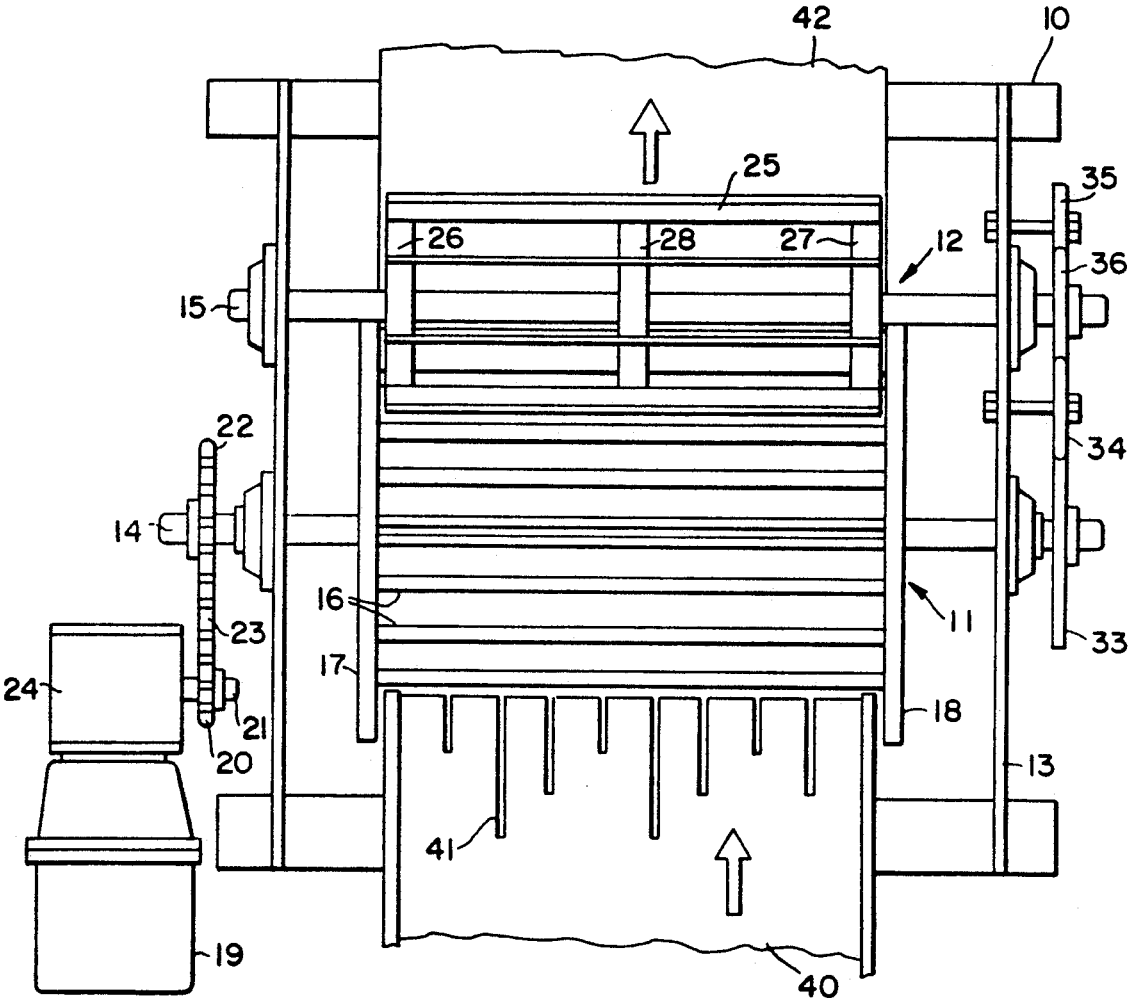
FIG. 1 is a top plan view of the sizing apparatus of the present invention.
Figure 2:
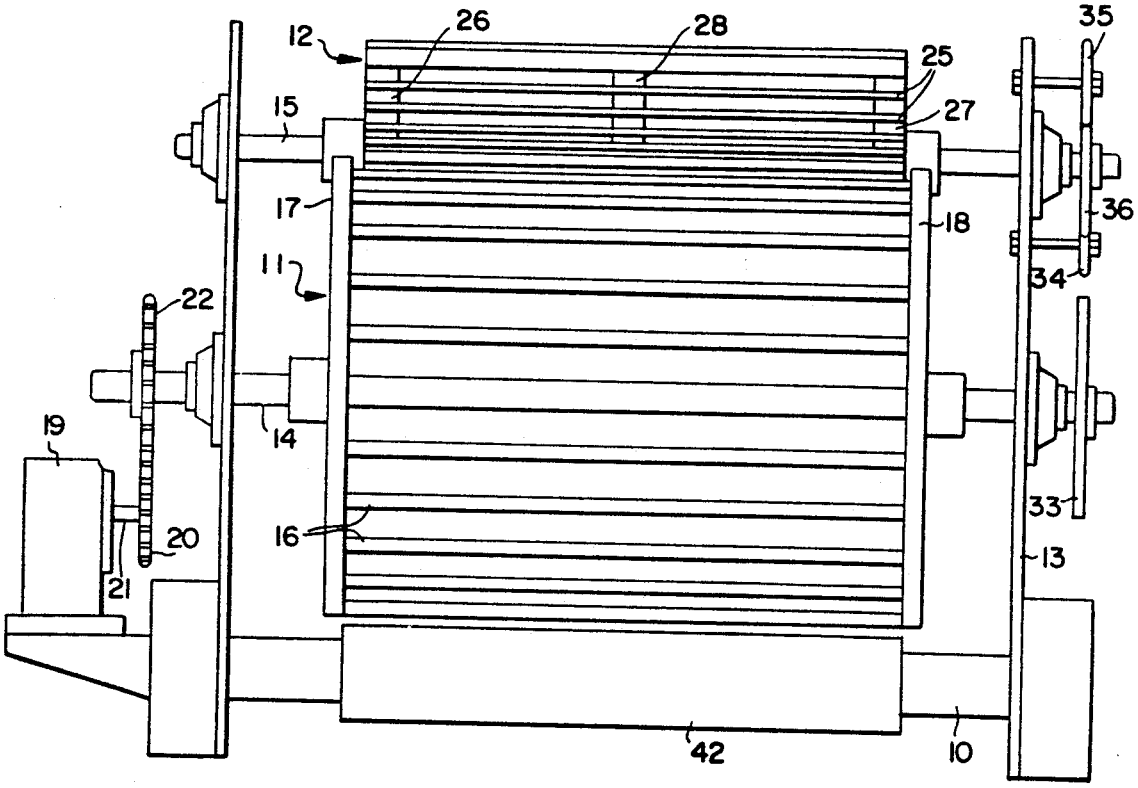
FIG. 2 is a front elevational view of the apparatus of FIG. 1.

Referring now to the drawing, the sizing apparatus of this invention includes a support frame 10 having mounted thereon a carrier drum 11 and a cutting drum 12, which are journaled on parallel horizontal shafts 14 and 15, respectively, secured to side plate 13 the frame. Carrier drum 11 has a plurality of longitudinal bars 16 mounted in spaced relation around the periphery of a pair of opposed circular end plates 17 and 18 to which the bars are secured, with the bars extending substantially parallel to shaft 14. The bars 11 are mounted equidistant around the periphery of the end plates, with the bars being spaced apart a distance equal to the maximum desired length of the food chunks to be sized. For example, if the maximum length of the meat chunks is 2 inches (5 cm) longitudinal bars are spaced apart 2 inches (5 cm) on center, around the periphery of the end plates. The radius A of carrier drum 11 is such that an even number of bars 16 are provided around the drum, with the specific number of bars depending on the desired capacity and throughput of the apparatus.

Carrier drum 11 is driven by motor 19 through sprocket 20, keyed to drive shaft 21, and sprocket 22, keyed to shaft 14, with the sprockets being connected by drive chain 23. Motor 19 is provided with a standard variable speed reducer 24 to rotate the carrier drum at a desired operating speed.

Cutting drum 12 which is mounted vertically above carrier drum 11, adjacent a downwardly rotating section of drum 11, has a plurality of thin cutting blades 25 mounted equidistant around the periphery of circular end plates 26 and 27 and a central support plate 28, all of which have the same radius, with the cutting ends of blades 25 being spaced apart the same distance as longitudinal bars 16 on the carrier drum. The cutting blades 25 are mounted in notches 29 spaced around the periphery of support plates 26, 27 and 28 and are secured to the plates by means of wedges 30 and countersunk screws (not shown) with the ends of the blades extending beyond the peripheral surface of the plates. The radius of the imaginary cylinder which is formed by the ends of the blades is indicated at B.

Figure 3:
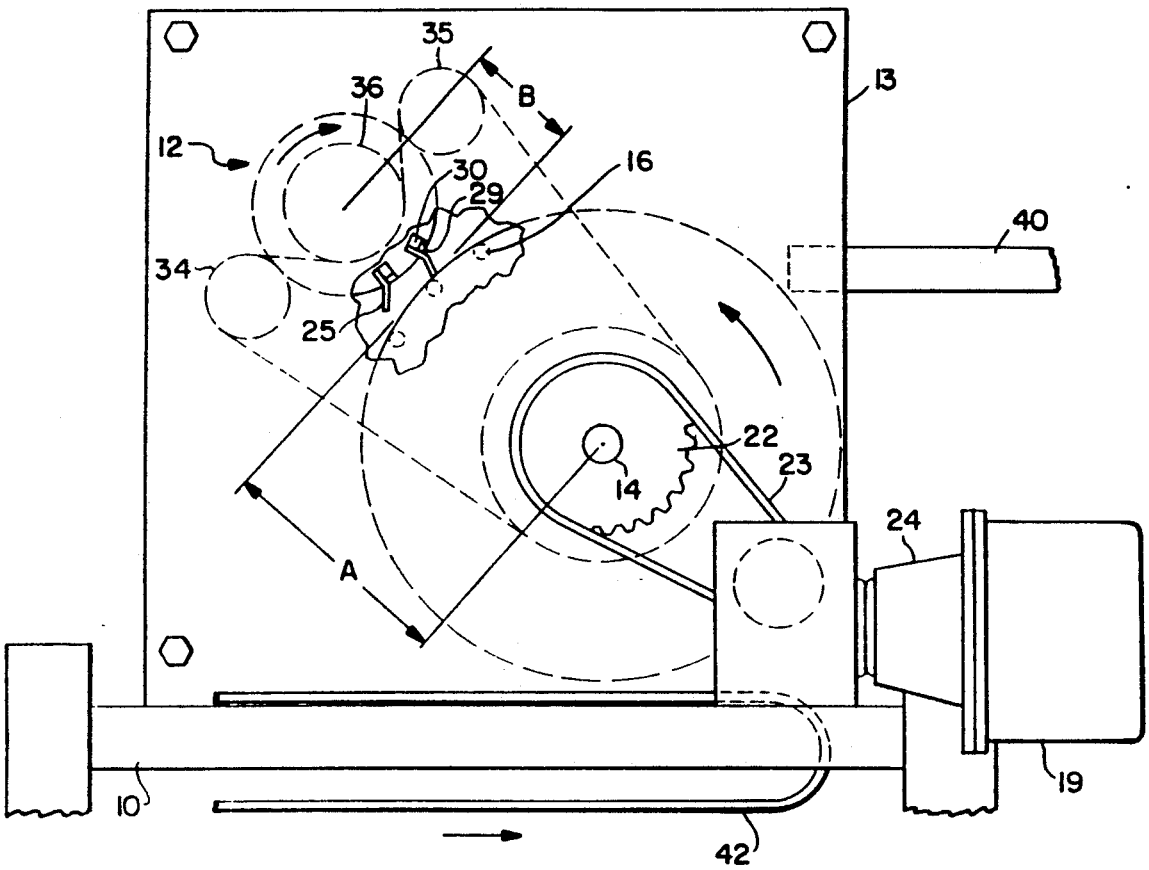
FIG. 3 is a side elevational view, partly in section, of the apparatus of FIG. 1.
Figure 4:
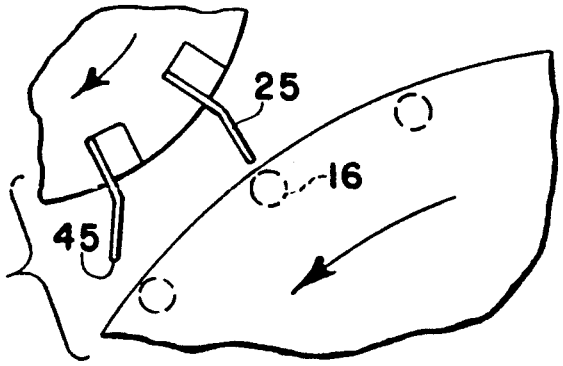
FIG. 4 is an enlarged fragmentary side elevational view illustrating the cooperation of a cutting blade with a longitudinal bar.

Blades 25 are mounted parallel to shaft 15 over substantially the entire length of bars 16, with the blades 25 being aligned to cooperate with the bars 16 upon rotation of the drums in opposite directions (as shown by the arrows in FIG. 3) to cut elongated chunks carried on the upper surface of the bars into the nip between the drums. Preferably the end of each of the blades 25 is slightly inclined, with reference to the axis of the shaft 15, in the direction of rotation of the cutting drum. The cutting drum 12 is aligned with the carrier drum 11 in a manner such that upon rotation of the drums in opposite directions, the ends of the blades do not strike against the longitudinal bars. Rather, as shown in FIG. 4, the end 45 of each blade 25 passes slightly above the midpoint of a corresponding longitudinal bar, but is spaced a short distance therefrom, such as by about 0.015 to 0.031 inches (0.0375 to 0.08 cm), whereby a food chunk carried on the bar is almost completely severed during passage through the nip, with the pieces becoming completely separated as they fall through the bars and during processing. Alternatively, the cutting drum 12 and the carrier drum 11 may be mounted and driven so that upon rotation of the drums in opposite directions, the leading edge of each cutting blade passes slightly behind the trailing edge of a longitudinal bar, such as by about 0.015 to 0.062 inches (0.0375 to 0.155 cm).

Cutting drum 12 is rotated by means of drive chain 32 which extends around sprocket 33 mounted on shaft 14 of the carrier drum, idler sprockets 34 and 35, and sprocket 36 mounted on shaft 15, so that cutting drum 12 will be rotated in a direction opposite to that of the carrier drum 11. According to a preferred embodiment, the circumference of support plates 26, 27 and 28 is such that the number of cutting blades mounted on the plates is one-half the number of longitudinal bars on carrier drum 11, with the cutting drum 12 being driven at a peripheral speed of two times that of the carrier drum 11.

Vibratory conveyor 40 is mounted adjacent the upper section of carrier drum 11 with the longitudinal axis of the conveyor being perpendicular to the longitudinal axes of the bars 16 on the carrier drum, to deposit a mix of random sized meat chunks carried from a hopper (not shown) onto the upwardly rotating section of the carrier drum. Vibratory conveyor 40 includes a plurality of longitudinal divider members 41 at the discharge end of the conveyor which are spaced apart a distance equal to the maximum desired length of the meat chunks in the mix to be sized, to align such elongated chunks with their longitudinal axes in parallel alignment with their direction of travel on the conveyor, as shown by the arrow in FIG. 1. In this manner, the aligned elongated chunks discharged from conveyor 40 are deposited on the surface of the rotating carrier with the longitudinal axes of the elongated chunks being perpendicular to the axis of the longitudinal bars, so that the elongated chunk extend across two or more adjacent bars. Smaller sized chunks in the mix fall through the space between adjacent bars and through the carrier drum. Preferably, the upstream ends of divider members 41 are staggered in length to prevent bridging of the elongated chunks across adjacent dividers as the random sized mix is carried along the conveyor.

A take-away conveyor 42, such as a conventional endless belt or other suitable collection means, is mounted beneath the carrier drum 11 to receive small sized chunks which fall through the longitudinal bars, as well as elongated chunks which are cut to the desired maximum length by the action of cutting drum 12. The chunks deposited on the conveyor 42 are carried to suitable processing equipment, such as conventional fillers, or to storage.

What is claimed is:

1. Apparatus for sizing a mix of randomly sized food pieces into pieces of a predetermined maximum length which comprises a first cylindrical member and a second cylindrical member mounted for rotation on parallel axial shafts and interconnected for rotation in opposing directions, said first cylindrical member having a pair of spaced circular support plates mounted on a first axial shaft and a plurality of axially parallel longitudinal bars mounted between the support plates equidistant around the periphery thereof substantially parallel to said first shaft and spaced apart a distance equal to the desired maximum length of the food pieces to be sized, said second cylindrical member having a plurality of spaced circular support plates mounted on a second axial shaft and a plurality of axially parallel elongated cutting blades mounted on the support plates equidistant around the periphery thereof substantially parallel to said second shaft and spaced apart a distance equal to the spacing between the longitudinal bars on said first cylindrical member, and first conveyor means having an end adjacent said first cylindrical member for depositing a mix of randomly sized food pieces, including elongated pieces having a length exceeding a predetermined maximum length, onto said first cylindrical member with the longitudinal axes of said elongated pieces being substantially perpendicular to the axes of the longitudinal bars on said first cylindrical member, said cylindrical members being operably mounted and driven so that said cutting blades pass in close proximity to said longitudinal bars without contacting said bars to thereby cut elongated pieces carried on the first cylindrical member between the rotating members.

2. The apparatus defined in claim 1 in which said first conveyor means comprises a vibratory conveyor mounted adjacent an upwardly rotating section of the first cylindrical member, with the longitudinal axis of the first conveyor being substantially perpendicular to the longitudinal axes of the bars on said first member, said first conveyor means having a plurality of longitudinal divider members mounted at the end of said conveyor adjacent the first cylindrical member, with the divider members being spaced apart a distance equal to the desired maximum length of the food pieces.

3. The apparatus defined in claim 2 in which the ends of said divider members remote from the first cylindrical member are staggered in length.

4. The apparatus defined in claim 1 in which the circumference of the first cylindrical member is twice that of the second cylindrical member and the number of cutting blades carried on said second member is one-half the number of longitudinal bars carried on said first cylindrical member.

5. The apparatus defined in claim 4 in which the second cylindrical member is rotated at twice the rotational speed of the first cylindrical member.

6. The apparatus defined in claim 1 in which said first and second cylindrical members are mounted and driven so that the end of each blade passes above the midpoint of a cooperating one of said longitudinal bars during said severing.

7. The apparatus defined in claim 1 in which a second conveyor means is mounted below the first cylindrical member at the end of the first conveyor adjacent said first cylindrical member to receive food pieces which pass through the first cylindrical member.

8. The apparatus defined in claim 6 in which the end of a blade passes above the midpoint of a cooperating one of said longitudinal bars by a distance of about 0.0375 cm. to 0.08 cm. during said cutting.

9. The apparatus defined in claim 1 in which the second axial shaft on which the second cylindrical member is carried is mounted above the first axial shaft adjacent a downwardly rotating section of the first cylindrical member.

* * * * *